US005195588A

United States Patent [19]

Dave

[11] Patent Number: 5,195,588

[45] Date of Patent: Mar. 23, 1993

[54] APPARATUS AND METHOD FOR TESTING AND REPAIRING IN A CASED BOREHOLE

[75] Inventor: Yogesh S. Dave, Stamford, Conn.

[73] Assignee: Schlumberger Technology Corporation, New York, N.Y.

[21] Appl. No.: 815,982

[22] Filed: Jan. 2, 1992

[51] Int. Cl.[5] ..... E21B 33/13; E21B 43/11; E21B 49/08

[52] U.S. Cl. ..... 166/255; 166/264; 166/277; 166/385; 166/387

[58] Field of Search ..... 166/264, 277, 285, 297, 166/55.1, 298, 284, 385, 255, 387

[56] References Cited

U.S. PATENT DOCUMENTS

| | | | |
|---|---|---|---|
| 2,236,987 | 4/1941 | Bechtold | 166/21 |
| 2,695,669 | 11/1954 | Sidwell | 166/29 |
| 2,743,743 | 5/1956 | Galloup | 166/277 X |
| 2,761,511 | 9/1956 | Billue | 166/29 |
| 2,813,584 | 11/1957 | Teplitz | 166/264 |
| 2,846,876 | 8/1958 | Willingham, Jr. | 166/264 X |
| 2,880,096 | 3/1959 | Hurley | 106/31 |
| 3,036,633 | 5/1962 | Mayhew | 166/31 |
| 3,121,459 | 2/1964 | Van Ness, Jr. et al. | 166/264 |
| 3,194,310 | 7/1965 | Loomis | 166/277 X |
| 3,197,317 | 7/1965 | Patchen | 106/97 |
| 3,220,863 | 11/1965 | Mayhew | 106/96 |
| 3,329,204 | 7/1967 | Brieger | 166/264 X |
| 3,363,689 | 1/1968 | Smith et al. | 166/29 |
| 3,364,993 | 1/1968 | Skipper | 166/277 X |
| 3,376,146 | 4/1968 | Mitchell | 106/97 |
| 3,669,701 | 6/1972 | Biederman, Jr. | 106/120 |
| 3,750,750 | 8/1973 | Urbanosky | 166/187 |
| 3,774,683 | 11/1973 | Smith et al. | 166/293 |
| 3,783,940 | 1/1974 | Urbanosky | 166/181 |
| 3,844,351 | 10/1974 | Sutton et al. | 166/293 |
| 4,690,216 | 9/1987 | Pritchard, Jr. | 166/264 |
| 4,742,459 | 5/1988 | Lasseter | 364/422 |
| 4,860,581 | 8/1989 | Zimmerman et al. | 73/155 |
| 4,869,321 | 9/1989 | Hamilton | 166/277 |
| 5,056,595 | 10/1991 | Desbrandes | 166/264 |

OTHER PUBLICATIONS

Lee Product Data Sheet, "Lee Betaplug", Mar. 1991.

Schlumberger Offshore Services brochure, "Schlumberger Cased Hole Repeat Formation Tester", 1987.

G. Bol et al., "Putting a Stop to Gas Channeling", Schlumberger Oilfield Review, Apr. 1991.

G. Catala et al., "Modernizing Well Cementing Design and Evaluation", Schlumberger Oilfield Review, Apr. 1991.

A. A. Abdel-Mota'al, "Detection and Remedy of Behind-Casing Communication During Well Completion", SPE 11498, Mar. 1983.

"A New Cased Hole Formation Tester From HLS", Halliburton Logging Services, Inc., Bakersfield Division Office.

"Self-Drilling Toggle", Design News, p. 48 (Jul. 8, 1991).

M. J. Economides, "Implications of Cementing on Well Performance", Dowell Schlumberger, Well Cementing, Schlumberger Educational Services (1990).

C. Marca, "Remedial Cementing", Dowell Schlumberger, Well Cementing, Schlumberger Educational Services (1990).

*Primary Examiner*—Stephen J. Novosad

*Attorney, Agent, or Firm*—Marc D. Foodman; Martin M. Novack

[57] ABSTRACT

An apparatus is disclosed for perforating, testing, and repairing casing in an earth borehole. A device is moveable through the casing. The device can be mounted on a wireline, on tubing, or on both. A perforator is mounted in the device for producing a perforation in the casing. The device will also generally include components for hydraulic testing/sampling from the formations behind the casing. A plugger is mounted in the device for plugging the perforation with a solid plug or a non-solid sealant.

38 Claims, 8 Drawing Sheets

APPARATUS AND METHOD FOR TESTING AND REPAIRING IN A CASED BOREHOLE

FIELD OF THE INVENTION

This invention relates to the field of investigating formations surrounding earth boreholes and, more particularly, to testing of formations surrounding cased boreholes and the repairing of perforations in casing.

BACKGROUND OF THE INVENTION

In the drilling and/or producing of an earth borehole steel casing may be routinely used in one or more sections of the borehole, and cement is employed on the outside of the casing to hold the casing in place and to provide a degree of structural integrity and a seal between the formation and the casing.

There are various circumstances in which it is necessary or desirable to make one or more perforations through the casing and cement in order to perform tests behind the casing, and through the surrounding cement, if present. For example, a commercially used technique employs a tool which can be lowered on a wireline to a cased section of a borehole, the tool including a shaped explosive charge for perforating the casing, and testing and sampling devices for measuring hydraulic parameters of the environment behind the casing and/or for taking samples of fluids from said environment.

After testing through perforations in casing, it is sometimes decided to perforate the well for production or to abandon and plug the zone. The term "plugging" traditionally means plugging an entire cross section of the well. Perforations can be plugged with cement through drill pipes. Elastomeric plugging is also used to plug an entire well by isolating the zone below the plug during or after the production. Elastomeric plugs are also used as an anchor for setting cement. Well treatment and plugging can also be done with coiled tubing.

A drawback of using a tool that perforates casing for testing is that the perforation which remains in the casing can cause problems in cases where production or zone plugging does not quickly follow. In some fortunate instances the perforation may become clogged with debris from the borehole and rendered essentially harmless if the debris permanently plugs the perforation. However, if the perforation, or part of it, remains open, a substantial volume of formation fluids may be lost into the formations and/or may degrade the formations. In some situations, fluids from the formations may enter the borehole with deleterious effect. Gas intrusion into the borehole can be particularly problematic.

It is among the objects of the present invention to address the problems of perforating and testing in cased sections of an earth borehole, and to devise an apparatus and method which solves the problem in a practical way.

SUMMARY OF THE INVENTION

In accordance with a form of the present invention, there is provided an apparatus for perforating, testing, and repairing casing in an earth borehole. A device is moveable through the casing. The device can be mounted on a wireline, on tubing, or on both. Perforating means are mounted in the device for producing a perforation in the casing. The device will also generally include means for hydraulic testing/sampling (that is, testing for hydraulic properties such as pressure or flow rate, and/or sampling fluids) from the formations behind the casing. Plugging means are also mounted in the device for plugging the perforation. In an embodiment of the invention, the means for plugging the perforation comprises means for inserting a plug of a solid material into the perforation. In this embodiment, means are provided for setting said device at a substantially fixed location in the borehole, and means are also provided for actuating the perforating means and the plugging means while said device is set at a substantially fixed location. Also in this embodiment, means are provided for moving the plugging means to a position opposite the perforation. In another embodiment of this form of the invention, the plugging means is operative to inject a non-solid sealant (such as a cement or epoxy) into the perforation.

An advantage of a form of the present invention is that it can be implemented with a wireline device and does not require tubing, although tubing can be used if desired. A further advantage of a form of the present invention is that a perforation can be plugged while the tool is still set in the position at which the perforation was made, so the plugging operation can be specifically and accurately directed to the perforation, without the need for locating the perforation or for wasting the plugging medium by plugging a region that is larger than the perforation itself. The hydrostatic pressure in the borehole is usually higher than the formation pressure, and this helps prevent the plug from being blown out once it is set. This is particularly so in the case of a solid tapered plug, which will tend to be set tighter by the hydrostatic pressure.

In accordance with an embodiment of a further form of the invention, an apparatus is provided for plugging existing perforations in casing in an earth borehole. A device, which may be mounted on a wireline, is moveable through the casing and includes means mounted in the device for locating individual perforations in the casing. The device includes plugging means for plugging the located perforation.

Further features and advantages of the invention will become more readily apparent from the following detailed description when taken in conjunction with the accompanying drawings.

DETAILED DESCRIPTION

Figure 1:
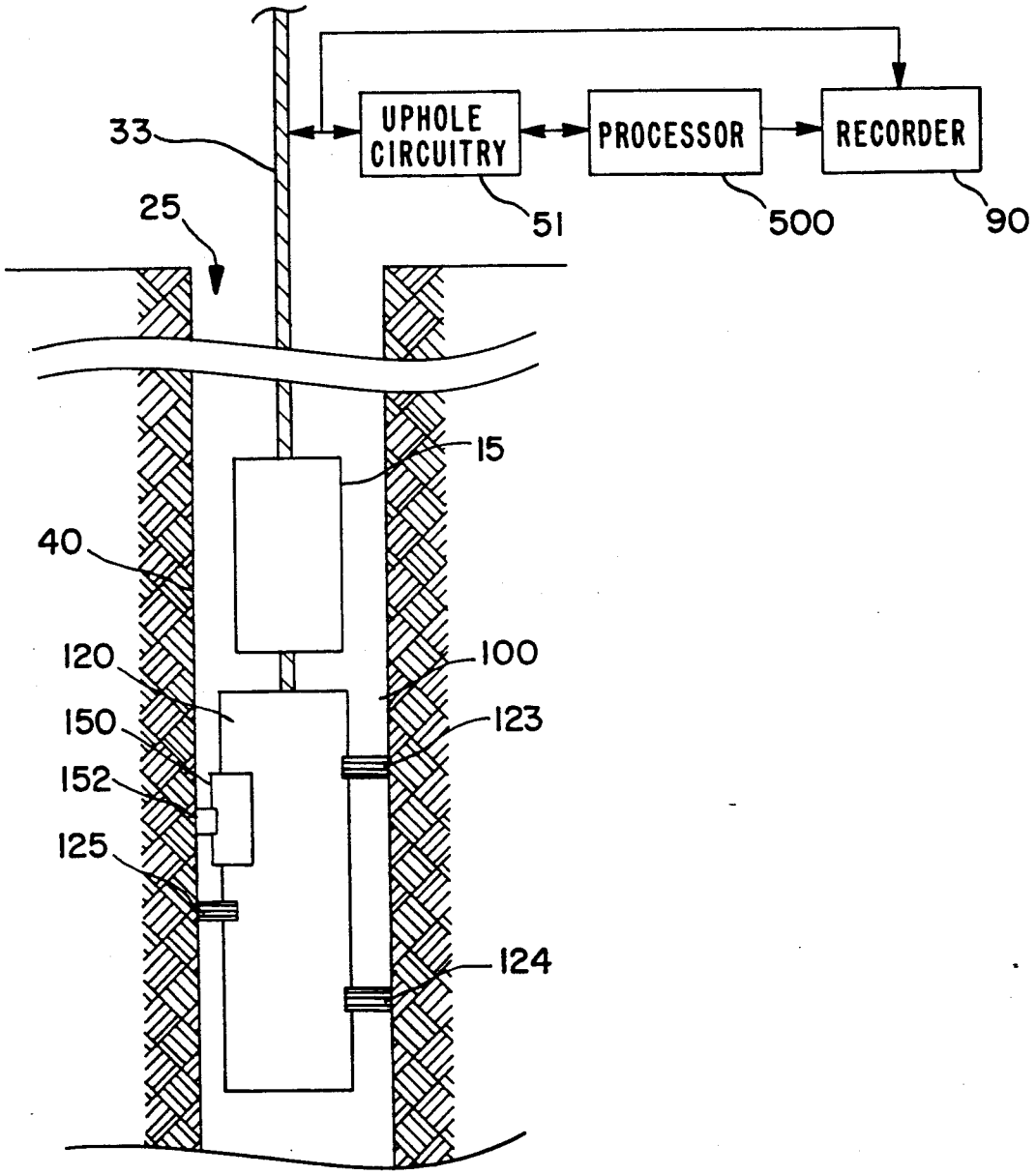
FIG. 1 is a schematic diagram, partially in block form, of an apparatus in accordance with the invention and which can be used to practice the method of the invention.

Referring to FIG. 1, there is shown an apparatus in accordance with an embodiment of the invention and which can be used to practice an embodiment of the method of the invention. A borehole 25 is typically although not necessarily filled with drilling fluid, brine or water. The illustrated portion of the borehole is cased with casing 40. A device 100 is suspended in the borehole 25 on an armored multiconductor cable 33, the length of which substantially determines the depth of the device 100. Known depth gauge apparatus (not shown) is provided to measure cable displacement over a sheave wheel (not shown) and thus depth of the logging device 100 in the borehole 25. The cable length is controlled by suitable means at the surface such as a drum and winch mechanism (not shown). Circuitry 51, shown at the surface although portions thereof may typically be downhole, represents control, communication and preprocessing circuitry for the logging apparatus. This circuitry may be of known type and is not, per se, a novel feature of the present invention. A processor 500 and a recorder 90 may also typically be provided uphole.

In the illustrated embodiment hereof, the device or tool 100 has a generally cylindrical body 120 which encloses most of the downhole operating electronics, hydraulics, and testing means, and mounts a gunblock 150 that contains a perforating subsystem and a plugging subsystem, to be described. The gunblock 150 has a packer 152. A subassembly 15 is mounted above the device 100 and is electrically and hydraulically coupled therewith. The subassembly 15 contains hydraulic power, electrical power, chambers, and communications capabilities, as known in the art. In the illustrated embodiment, tool-setting pistons 123 and 124 are mounted within the tool body opposite the gunblock 150 and the tool-setting piston 125 is mounted in the tool body adjacent the gunblock.

Details of the structure of the tool 100 and the operation thereof are set forth hereinbelow. Very briefly, however, operation of the tool is as follows. When at the borehole location to be tested, the tool is set and the perforating charge in the gunblock is fired to perforate the casing. Testing and/or sampling can then be implemented. With the tool still set, the gunblock, which is moveable in this form of the invention, is moved such that a plugging mechanism therein opposes the perforation. A plug is then inserted in the perforation to repair the perforation.

Figure 2:
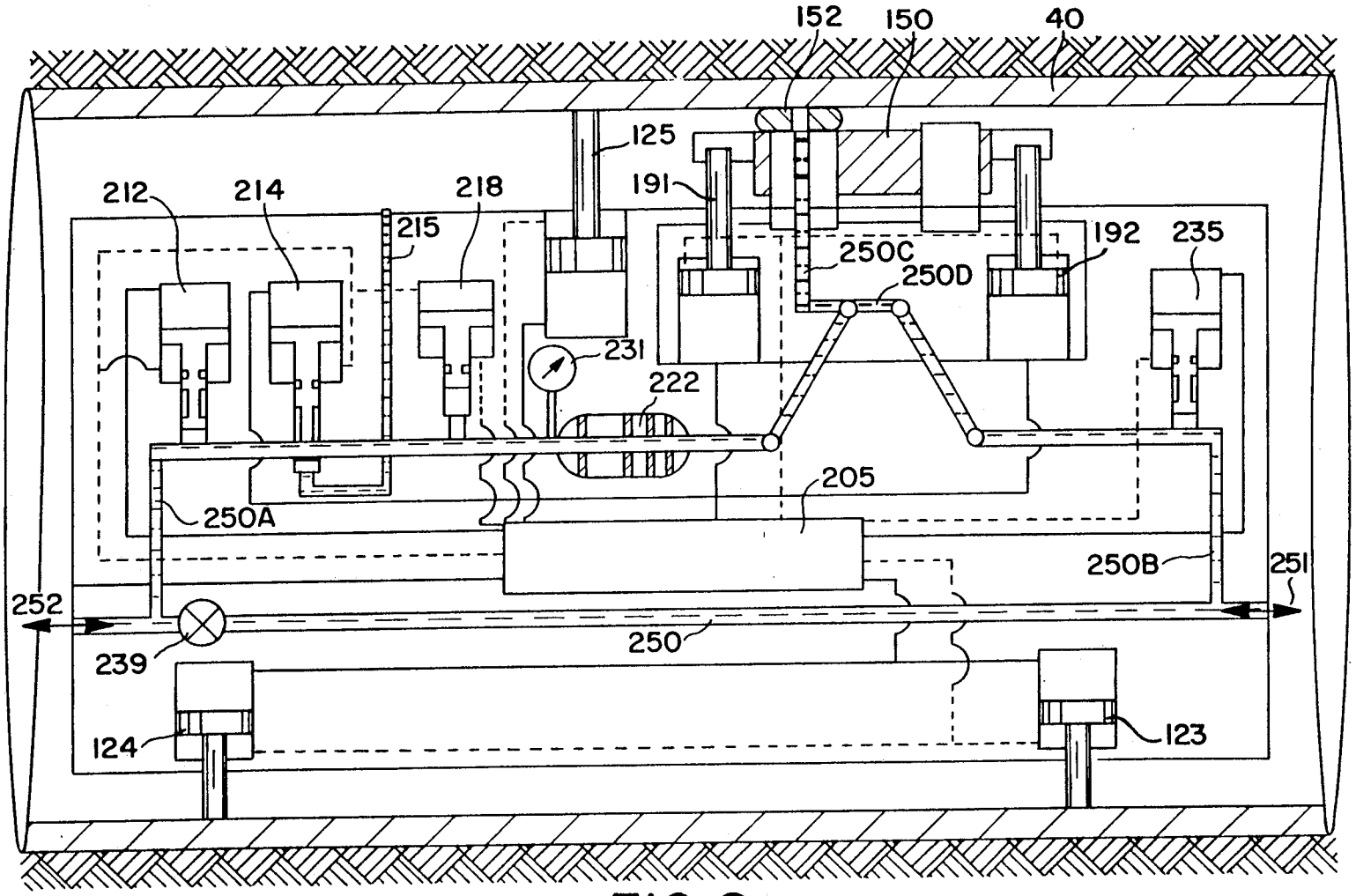
FIG. 2 is a schematic diagram illustrating the hydraulic control, testing and sampling flow lines, and other features of the FIG. 1 embodiment.

Referring to FIG. 2, there is shown a schematic diagram of the main fluid flow line 250 of the FIG. 1 embodiment, and of the branch flow lines, valves, pistons, and other elements that communicate with the flow line or operate in conjunction therewith. Also illustrated are control lines (shown in solid and dashed line), which are hydraulic lines in this embodiment. Hydraulic pressure can be generated by electrical motor and pump, controlled electronically in known manner. The lines to or from the processor 205 indicate the presence of electronic control. Hydraulic power lines are not separately shown. It will be understood that any suitable technique of valve and piston control can be utilized. As is known in the art, the flow line 250 can be typically coupled with one or more sampling chambers (not shown), as represented at arrow 251. The branches 250A and 250B of the flow line are coupled with a branch 250C via a coupling 250D that can be a flexible and/or telescopic coupling to accommodate gunblock movement. The branch 250C communicates with the opening in packer 152 on gunblock 150, which is shown with the apertures that contain the perforating and plugging subsystems, to be described. An isolation vale 212 is coupled in the flow line branch 250A, and is under processor control. As represented at arrow 252, the left-most end of flow line 250 can be coupled with instrumentation (not shown) such as chambers and other formation testing equipment which are not part of the novel structure of the invention. Also coupled with branch 250A is an equalizing valve 214 which controls coupling to an equalizing flow line 215 that communicates with the borehole fluid, and a pretest chamber 218. The branch 250A also includes a resistivity measuring cell 222 and pressure and temperature gauges which are represented at 231. The resistivity measuring cell 222 operates in conventional fashion to measure the resistivity of fluids passing therethrough. Coupled with the branch 250B is an isolation valve 235. The diagram of FIG. 2 also shows the tool setting pistons 123, 124 and 125, and gunblock setting pistons 191 and 192, all shown extended; i.e., with the tool and packer set.

Figure 3:
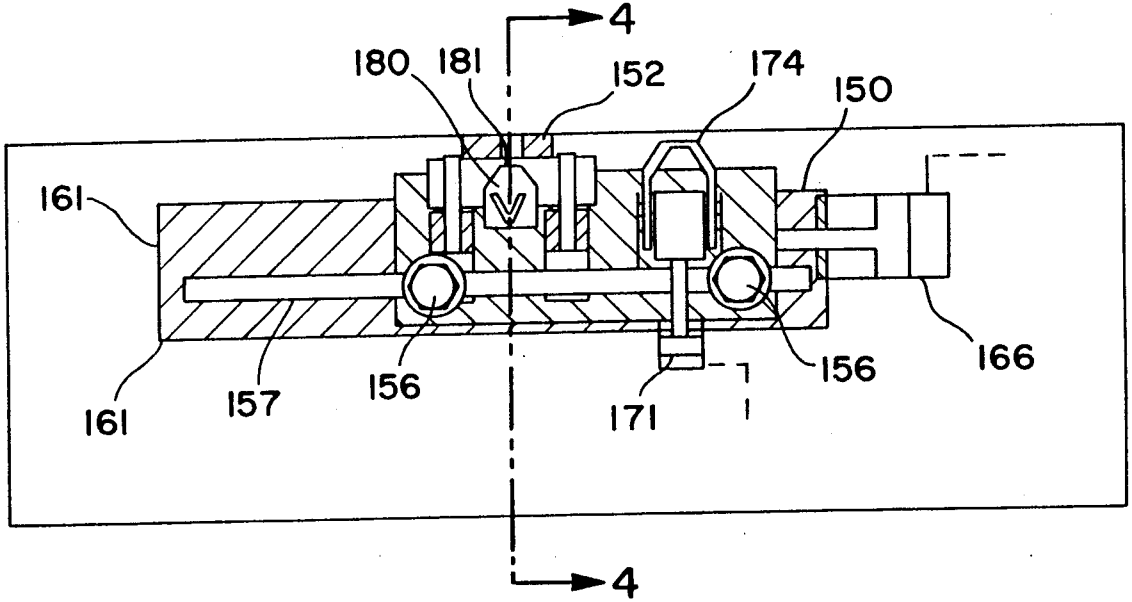
FIG. 3 is a cross-sectional view, partially in schematic form and partially broken away, of a portion of the tool of the FIG. 1 embodiment, which illustrates the operation thereof.
Figure 4:
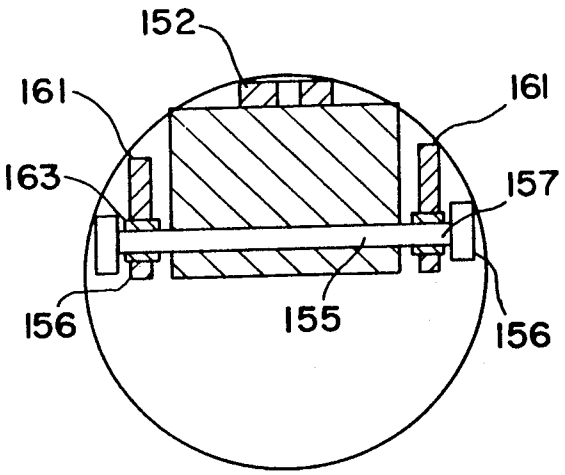
FIG. 4 is a cross-sectional view as taken through a section defined by the arrows 4—4 of FIG. 3.

Referring to FIGS. 3 and 4, there is shown a diagram of an embodiment of a sliding gunblock 150 as employed in the apparatus of FIGS. 1 and 2. Shafts 155 (one of which is visible in FIG. 4) pass through bores in the lower portion of the gunblock 150, and the shafts 155 are slidably mounted in slots 157 of fixed guides 161 that are, in turn, secured to the pistons 191, 192 (FIG. 2), coupled with the body 120 of the tool. The shafts 155 have stops 156 at their ends, and the slots can be provided with bearings, as shown at 163, to facilitate movement of the shafts 155 in the slots. In one portion of the gunblock is mounted a perforating subsystem comprising a shaped charge 180 located behind a perforation cap 181 and the packer 152. The charge 180 is conventionally coupled with a detonator (not separately shown) that is under electrical control of the processor 250 which is in communication with uphole control electronics. Adjacent the perforating subsystem is a plugging subsystem that includes a piston 171, the front end of which engages a plugging assembly 174 that is described in further detail in conjunction with FIGS. 6 and 7. A piston 166 causes the gunblock 150 to slide between two predetermined positions. The piston excursion is arranged such that in the second such position the center of the plugging assembly moves to the position originally occupied by the center of the perforating subassembly.

Figure 6:
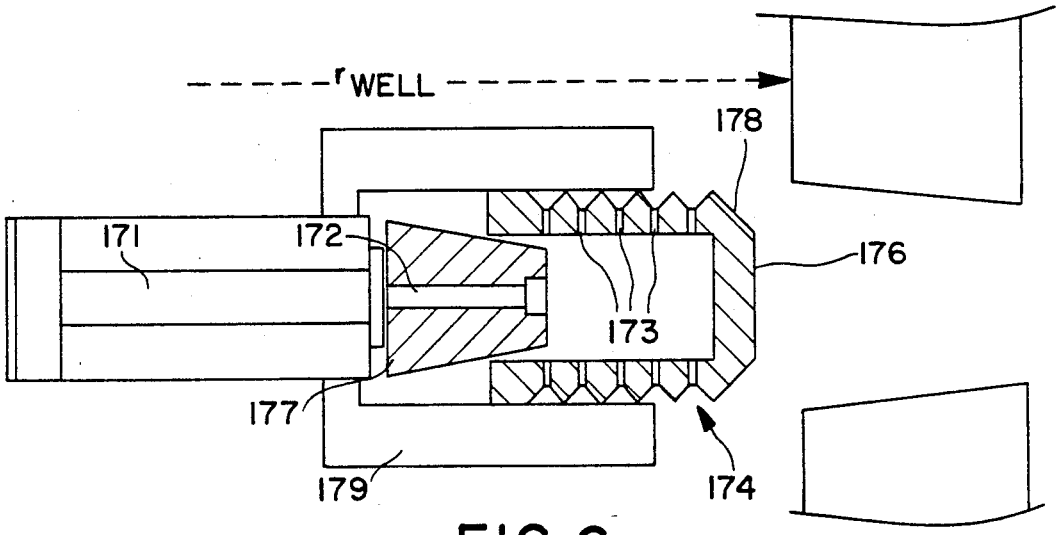
FIGS. 6 and 7 are side sectional views which illustrate operation of the plugging mechanism and plugging assembly in accordance with an embodiment of the invention.
Figure 7:
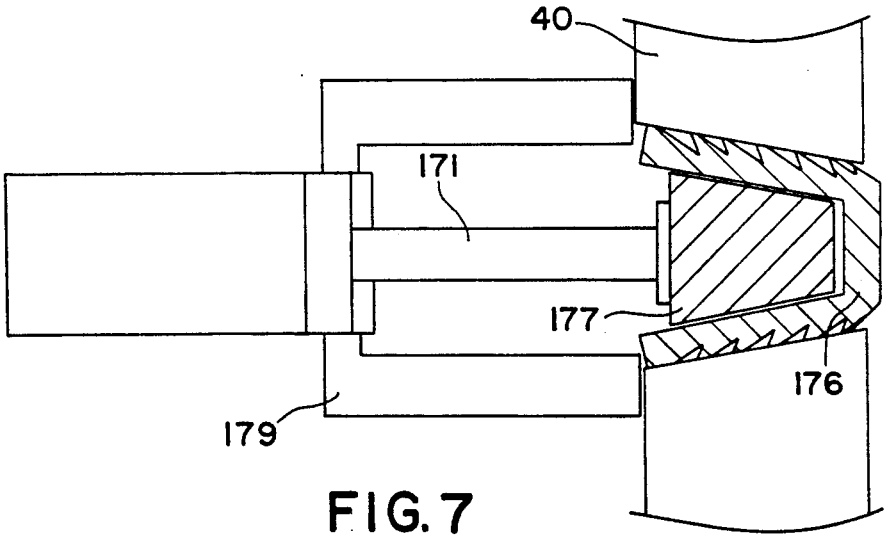

Referring to FIG. 6, there is illustrated an embodiment of the plugging assembly 174 of FIG. 3. Mounted within a cylindrical holder 179, and in front of piston 171, is a plug assembly which comprises a tubular socket component 176 having a closed front end and a tapered plug component 177 that is partially inserted in an opened end of socket component 176. The plug and socket components may both be formed of metal or other suitable material. The front outside surface 178 of the socket component is tapered, and the socket is grooved to provide some flexibility. Reference can be made, for example, to a commercially available type of metal plug called a "Lee Plug" sold by The Lee Company, Westbrook, Conn., which, to Applicant's knowledge, is conventionally used for plugging in above-ground applications. In operation, when the piston 171 moves forward with substantial force, the plug component 177 moves the socket component 176 forward into the perforation in the casing 40. As the piston continues its forward excursion, the socket component is forced into the perforation and the plug component is forced into the socket component and tends to expand the opened portion of socket component to better seal the perforation (FIG. 7). The piston can then be retracted. The grooved construction of the socket member permits it to more readily conform to the periphery of an irregular perforation in the casing 40. The grooves help to form a seal and to prevent the plug from blowing out. If desired, a sealant can also be forced into the socket component, such as from a pre-loaded cartridge in the plug component or through an opening in the plug component, such as is shown at 172. Apertures can also be provided in the socket component, as shown a 173, so that sealant will be squeezed to the outside of the socket component and will enter the ridges on the outside surface of the socket component and tend to seal the plugging assembly in the perforation as represented generally in FIG. 7.

Figure 5:
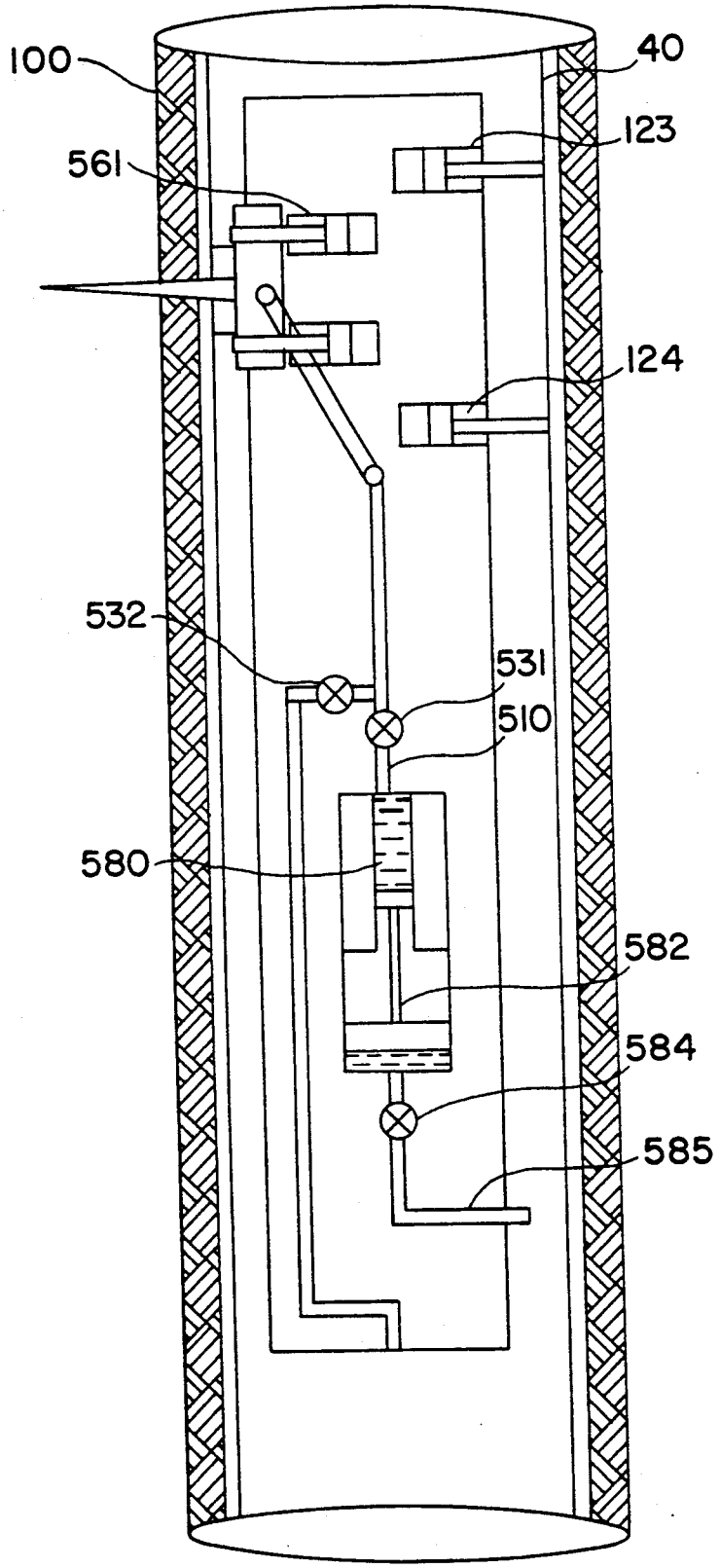
FIG. 5 is a schematic diagram of a further embodiment of the invention.

Referring to FIG. 5, there is illustrated an apparatus in accordance with a further embodiment of the invention. The tool 100 can again be suspended on a wireline (not shown), and includes hydraulics and controls of the type described in conjunction with FIG. 2. Tool-setting pistons 123 and 124 are again mounted in the tool body 120. In this embodiment, a gunblock 550 is provided that is stationary in the housing and includes a perforating subsystem as previously described. Gunblock setting pistons 561 and 562 are provided, as in the previous embodiment, as is a packer 552. A main flow line 250, and associated control valves, isolation and equalizing valves, pretest and sampling chambers (not shown) are provided, as in the prior embodiment. A further flow line 510 communicates with the packer aperture via valve 531, which is under control of processor 205 (FIG. 2). Valve 532 will be closed when valve 531 is opened. The flow line 510 is coupled to a reservoir 580 that is loaded with sealant, such as cement or epoxy. (Epoxy can form a very reliable seal, but is expensive. In the present application a relatively small quantity of epoxy can suffice.) The smaller head of a stepped piston 582 is coupled with the reservoir 580. The larger head of the stepped piston is coupled via valve 584 and a line 585 to the borehole environment. In the illustrated embodiment, the hydrostatic pressure of the borehole is used to move the stepped piston 582 and force the sealant contained in reservoir 580 into the perforation in the casing. The valve 584 is initially closed uphole, and it is opened under control of the processor 205 (FIG. 2) at the moment when the plugging operation is to be implemented. The pressure differential on the larger head of stepped piston 582 causes a force to be applied to the piston via line 585. A further hydraulic line (not shown) can also be used to provide power in conjunction with, or instead of, the line 585. The sealant may be, for example, a synthetic cement with components to be mixed uphole or downhole. Alternatively, a setting agent can be provided from a separate chamber (not shown). The cement and a setting agent can be combined in a separate chamber and stirred. A purge fluid can also be provided for the aperture or any of the indicated flow lines.

Figure 10:
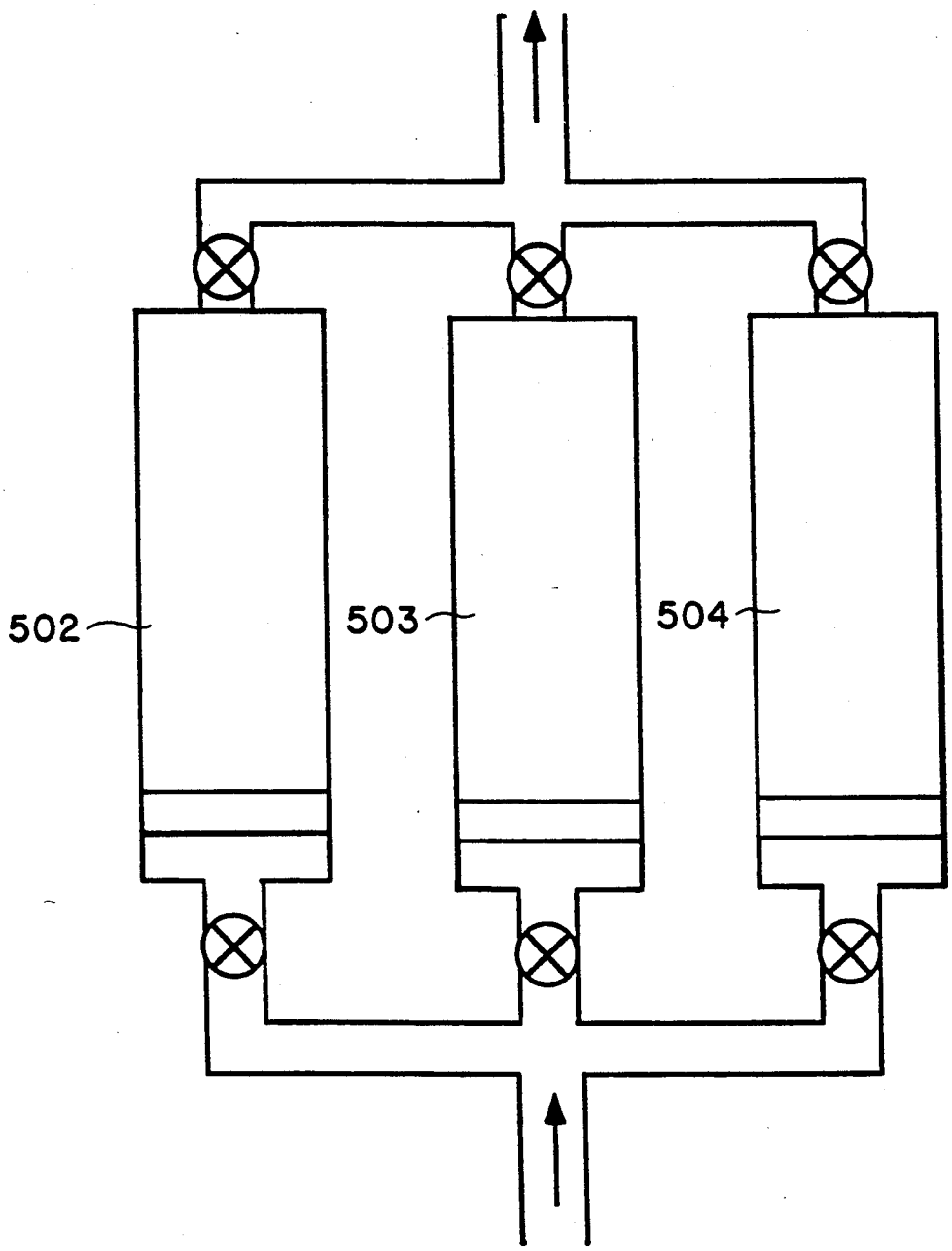
FIG. 10 shows an embodiment which employs multiple chambers for non-solid sealant.

FIG. 10 illustrates a modification of the FIG. 5 embodiment wherein a plurality of chambers (three being shown in the Figure) are used to carry components of a sealant. Sealant prepared at the surface may cause difficulty, as downhole heat may accelerate thickening. Using multiple chambers, different ingredients (such as cement, retardant, accelerator, etc. can be combined when plugging is to be performed. In FIG. 10, chambers 502, 503 and 504 are provided, and these chambers have valves at both ends, as in the FIG. 5 configuration. Stepped pistons can be used for one or more of these valves.

Figure 8:
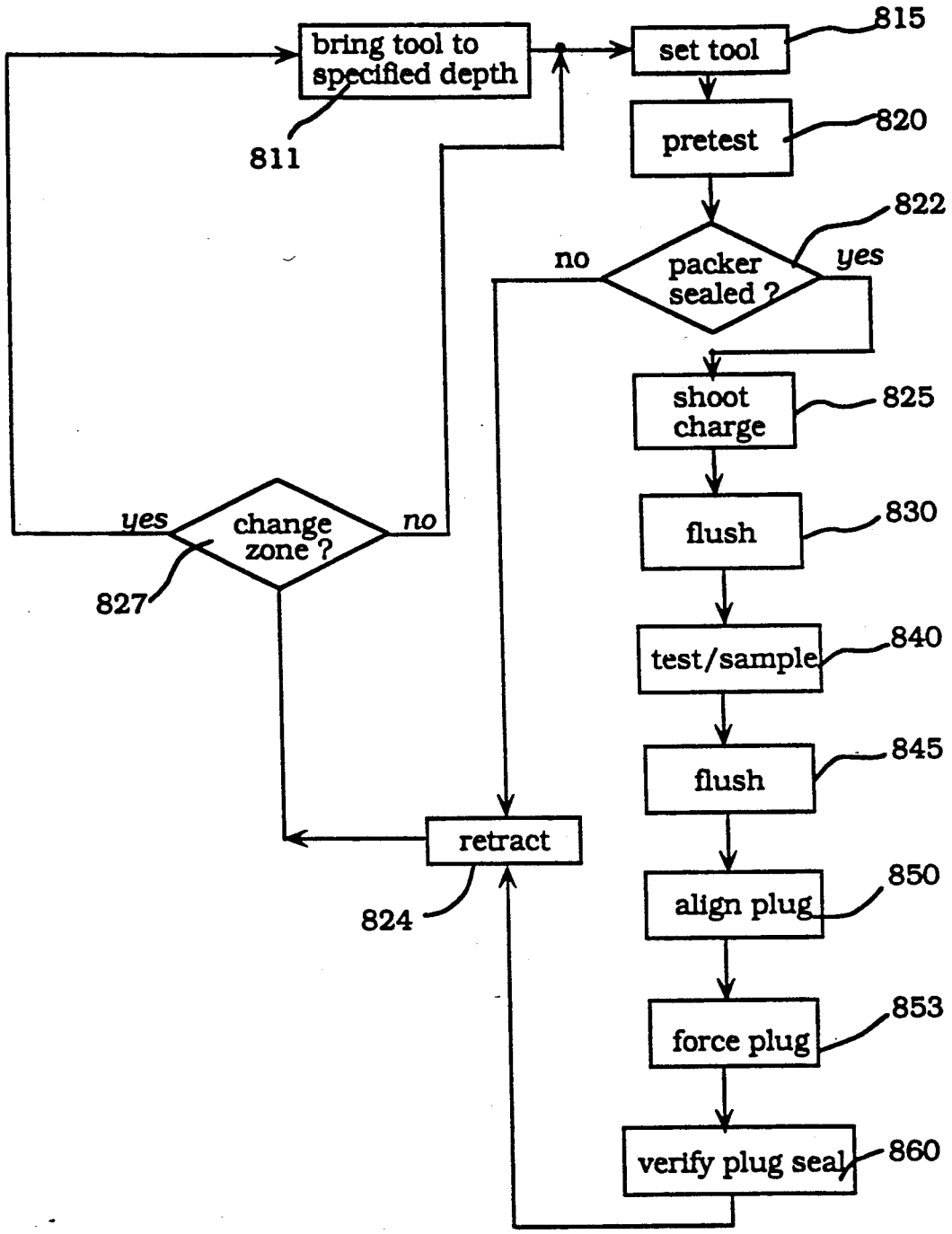
FIG. 8 is a flow diagram of a routine for controlling operation of embodiments of the invention.

Referring to FIG. 8, there is shown a diagram of a routine for the processor 205 for controlling operation of an embodiment of the invention. It will be understood that, if desired, some or all of the sequence could be controlled in other ways, for example from the earth's surface, such as via wireline communication link, with or without a downhole processor. The block 811 represents the bringing of the tool to a specified depth level. The tool is then set, as represented by the block 815. In FIG. 2, for example, the setting of the tool can be implemented by the pistons 123 and 124 and the gunblock setting pistons 191 and 192. A pretest can then be performed (block 820) to verify the seal. In FIG. 2, consider that isolation valves 212 and 235 are initially closed and equalizing valve is opened, so that the pressure read at gauge 231 is hydrostatic pressure of the borehole. Now, to perform the pretest the equalizing valve 214 is closed and the pretest piston 218 is withdrawn, to expand flowline volume. If the packer is sealed, the pressure will drop, whereas if it is not the pressure will return toward hydrostatic pressure. The diamond 820 represents inquiry as to whether the packer is sealed. If no (as determined in the pretest) the setting pistons are retracted (block 824), and a decision is made (diamond 827) as to whether the zone should be changed. The decision to change the zone can be made from the surface or, for example, can be implemented after a predetermined number of tries at sealing the packer. If the zone is not to be changed, the block 815 is re-entered directly. If, however, the zone is to be changed, the tool is brought to a new depth level (block 811), and the block 815 is then re-entered.

Returning, now, to diamond 822, if the packer is determined to be sealed, the shaped charge is shot (block 825) to make the perforation in the casing. An optional flushing operation can then be performed (block 830), such as by opening and closing equalizing valve 214. The block 840 is then entered, this block representing the performance of testing, injection, and/or sampling which may be of a type that is known in the art. In these operations, the indicated isolation valves and equalizing valves, and line valves such as represented at 239, are suitably controlled as samples are drawn and/or injected, and/or pressure, flow rate, resistivity, and other known measurements and/or analyses are made while in communication with the environment behind the casing. An optional flushing step (as above in block 830) can then again be performed, as represented by the block 845. The block 850 is then entered, this block representing, with regard to the embodiment of FIG. 3, the setting of tool anchoring piston 125, the release of gunblock setting pistons 191, 192, and the activation of the piston 166 which moves the gunblock 150 to align the plugging mechanism 174 with the perforation. The plugging mechanism (piston 171) is then activated, as represented by the block 853.

If a sealant is also used, it can be injected at this point. After plugging, a determination can be made (block 860) as to whether the plug has sufficiently sealed the perforation. This may be done, for example, by returning the piston 166 (and gunblock 150) to its original position, resealing the packer, and performing a pretest. Alternatively, the plugging mechanism can be provided with its own packer. If appropriate, further plugging, such as by sealant injection, can be implemented. The block 824 is then re-entered, and the setting pistons are retracted. The block 827 is then re-entered for a zone change determination. When the embodiment of FIG. 5 is utilized, the blocks 850 and 853 can be replaced by a block that implements injection of sealant, such as by control of valves 531, 532 and 584, as previously described.

Figure 9:
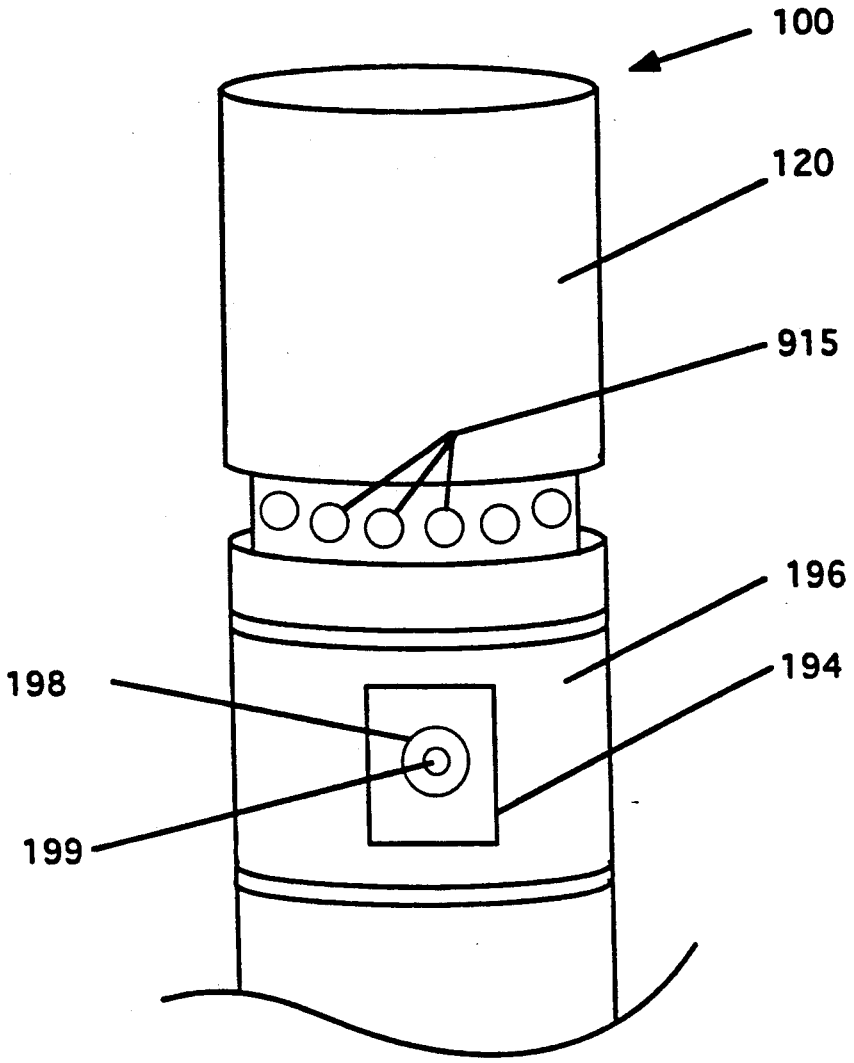
FIG. 9 is a side view partially broken away, of a further embodiment of the invention.

Referring to FIG. 9, there is shown an embodiment of a further form of the invention that can be used for locating and plugging existing perforations in casing in a borehole. In this embodiment, a tool 100 is suspended on a wireline, as in FIG. 1 and previously described embodiments, and only a portion of the apparatus is shown in FIG. 9. In this embodiment, an array of ultrasonic transducers 915 are provided in a ring around the tool body 120, and recessed therein. The transducers are scanned and used in a pulse/echo mode, as known in the art. Alternatively, one or more transducers can be mechanically scanned, such as by rotation. Located adjacent the transducers 915 is a rotatable cylindrical mounting ring 196 that can be rotated to a selected azimuthal orientation by an internal servomechanism. The ring 196 includes a mounting block 194, a packer 198, and a plugging mechanism 199 that can comprise a controlled piston, as described above in conjunction with FIGS. 3, 4, 6 and 7. A plug assembly is loaded in the plugging mechanism, as previously described.

In operation, the ultrasonic transducers can be scanned, and the signals bounced off the casing can be received and processed in known manner to determine if casing material is present. When a perforation or a defect is encountered, a substantially different echo will be received. After locating the perforation or defect, the tool can be set at the appropriate longitudinal position in the borehole, and the ring 196 can be rotated to the azimuthal orientation of the perforation or defect. The casing repair can then be implemented by plugging with a plug of a solid material. It will be understood that alternative plugging means, such as the sealant technique described in conjunction with FIG. 5, can be utilized. Also, it will be understood that more than one plugging means can be mounted in the tool, such as at different azimuthal positions on the ring 196, so that more than one plug can be utilized during a given run.

It will be understood, in all embodiments hereof, that, if desired, tubing could be run to the tool. It will also be understood that a plurality of gun blocks can be utilized on a tool to provide a plurality of perforating and/or repairing means. Further, perforation could be performed by drilling or other non-explosive means which can tend to produce perforations that are more uniform and easier to plug. Also, in the illustrated embodiments a single packer is described, but it will be understood that separate packers could be utilized for the perforating and plugging subsystem. Finally, radioactive tracers could be used in or on the plug material to facilitate relocating the plug.

I claim:

1. Apparatus for perforating and repairing casing in an earth borehole, comprising:

a device moveable through the casing;

perforating means mounted in said device for producing a perforation in said casing; and plugging means mounted in said device, for plugging said perforation by inserting a plug of solid material into the perforation.

2. Apparatus as defined by claim 1, further comprising means in said device for hydraulic testing/sampling via said perforation.

3. Apparatus as defined by claim 2, wherein said device is mounted on a wireline that can be lowered and raised in the borehole.

4. Apparatus as defined by claim 3, further comprising means for moving said plugging means to a position opposite said perforation.

5. Apparatus as defined by claim 4, wherein said moving means comprises means for effecting mechanical movement of said plugging means with respect to said device while said device is set at a substantially fixed location.

6. Apparatus as defined by claim 2, further comprising means in said device for setting said device at a substantially fixed location in said borehole, and further comprising means for actuating said perforating means and said plugging means while said device is set at a substantially fixed location.

7. Apparatus as defined by claim 1, wherein said device is mounted on a wireline that can be lowered and raised in the borehole.

8. Apparatus as defined by claim 7, further comprising means for also injecting a non-solid sealant in conjunction with said plug of a solid material.

9. Apparatus as defined by claim 7, further comprising means in said device for setting said device at a substantially fixed location in said borehole, and further comprising means for actuating said perforating means and said plugging means while said device is set at a substantially fixed location.

10. Apparatus as defined by claim 1, further comprising means for also injecting a non-solid sealant in conjunction with said plug of a solid material.

11. Apparatus as defined by claim 1, further comprising means for moving said plugging means to a position opposite said perforation.

12. Apparatus as defined by claim 11, wherein said moving means comprises means for effecting mechanical movement of said plugging means with respect to said device while said device is held at a substantially fixed location.

13. Apparatus as defined by claim 1, wherein said plugging means comprises a piston for forcing a plug into said perforation.

14. Apparatus as defined by claim 13, wherein said plug comprises a tubular tapered element that is substantially closed at one end.

15. Apparatus as defined by claim 13, wherein said plug comprises a two part assembly including a tubular socket component substantially closed at one end, and a tapered plug component in the opened end of said socket component.

16. Apparatus as defined by claim 1, wherein said plug comprises a metal plug.

17. Apparatus as defined by claim 1, wherein said plug comprises a two part assembly including a tubular socket component substantially closed at one end, and a tapered plug component in the opened end of said socket component.

18. Apparatus as defined by claim 1, wherein said plug includes at least one opening through which non-solid sealant can pass, and further comprising means for injecting said sealant into and through said plug.

19. A method for perforating and repairing casing in an earth borehole, comprising the steps of:

moving a device to a position in a cased region of said borehole;

setting said device at said position in the borehole;

perforating said casing from said device while said device is set at said position;

establishing fluid communication between said device and said perforation while said device is set at said position;

providing a solid plug in said device; and plugging said perforation from said device with said solid plug while said device is set at said position.

20. The method as defined by claim 19, further comprising the step of performing hydraulic testing/sampling via said perforation.

21. The method as defined by claim 19, wherein said step of moving said device comprises moving said device on a wireline that can be lowered and raised in the borehole.

22. Apparatus for plugging perforations in casing in an earth borehole, comprising:

a device moveable through the casing;

means mounted in said device for locating individual perforations in said casing; and plugging means mounted in said device for plugging the located perforations, said plugging means including means for inserting a plug of solid material into the perforation to obtain a permanent seal of the perforation.

23. Apparatus as defined by claim 22, wherein said device is mounted on a wireline that can be lowered and raised in the borehole.

24. Apparatus as defined by claim 23, wherein said means for plugging said perforation comprises means for injecting a non-solid sealant into said perforation.

25. Apparatus as defined by claim 22, wherein said plugging means comprises a piston for forcing a plug into said perforation.

26. Apparatus as defined by claim 22, wherein said plug comprises a metal plug.

27. Apparatus as defined by claim 22, wherein said plug comprises a two part assembly including a tubular socket component substantially closed at one end, and a tapered plug component in the opened end of said socket component.

28. A method for plugging perforations in casing in an earth borehole, comprising:

moving a device through the casing;

locating an individual perforation in said casing with the device; and plugging the located perforation from the device by inserting a plug of solid material into the perforation to obtain a permanent seal of the perforation.

29. Apparatus for perforating and repairing casing in an earth borehole, comprising:

a device moveable through the casing;

perforating means mounted in said device for producing a perforation in said casing;

plugging means mounted in said device, for plugging said perforation; and means in said device for moving said plugging means to a position opposite said perforation.

30. Apparatus as defined by claim 29, wherein said device is mounted on a wireline that can be lowered and raised in the borehole.

31. Apparatus as defined by claim 29, wherein said moving means comprises means for effecting mechanical movement of said plugging means with respect to said device while said device is held at a substantially fixed location.

32. Apparatus for plugging perforations in casing in an earth borehole, comprising:

a device moveable through the casing;

means mounted in said device for locating individual perforations in said casing; and plugging means mounted in said device for plugging the located perforations, said plugging means comprising a piston for forcing a plug into said perforation.

33. Apparatus for plugging perforations in casing in an earth borehole, comprising:

a device moveable through the casing;

means mounted in said device for locating individual perforations in said casing; and plugging means mounted in said device for plugging the located perforations with a metal plug.

34. Apparatus for plugging perforations in casing in an earth borehole, comprising:

a device moveable through the casing;

means mounted in said device for locating individual perforations in said casing; and plugging means mounted in said device for plugging the located perforations with a plug that comprises a two part assembly including a tubular socket component substantially closed at one end, and a tapered plug component in the opened end of said socket component.

35. A method for perforating and repairing casing in an earth borehole, comprising the steps of:

moving a device to a position in a cased region of said borehole;

setting said device at said position in the borehole;

perforating said casing from said device while said device is set at said position;

establishing fluid communication between said device and said perforation while said device is set at said position;

plugging said perforation from said device while said device is set at said position; and testing the seal formed by said plug while said device is set at said position.

36. The method as defined by claim 35, further comprising the step of performing hydraulic testing/sampling via said perforation.

37. The method as defined by claim 35, wherein said step of moving said device comprises moving said device on a wireline that can be lowered and raised in the borehole.

38. The method as defined by claim 36, wherein said step of moving said device comprises moving said device on a wireline that can be lowered and raised in the borehole.

* * * * *